US005452660A

United States Patent [19]

Stein

[11] Patent Number: 5,452,660

[45] Date of Patent: Sep. 26, 1995

[54] WASHING DEVICE SELECTIVELY ENGAGEABLE WITH PLURAL INKING PATHS

[75] Inventor: Lothar Stein, Sandhausen, Germany

[73] Assignee: Heidelberger Druckmaschinen Aktiengesellschaft, Heidelberg, Germany

[21] Appl. No.: 271,018

[22] Filed: Jul. 6, 1994

[30] Foreign Application Priority Data

Jul. 7, 1993 [DE] Germany ..... 43 22 615.9

[51] Int. Cl.[6] ..... B41F 35/04; B41L 41/04

[52] U.S. Cl. ..... 101/425; 101/423; 101/148; 101/350

[58] Field of Search ..... 101/350, 351, 101/352, 349, 207–210, 148, 425, 423

[56] References Cited

U.S. PATENT DOCUMENTS

| | | | |
|---|---|---|---|
| 3,766,853 | 10/1973 | Gallagher et al. . | |
| 4,036,131 | 7/1977 | Elmore | 101/247 |
| 4,414,897 | 11/1983 | Sato et al. . | |
| 4,643,092 | 2/1987 | Yamagishi et al. . | |
| 4,905,593 | 3/1990 | Gollinger et al. | 101/425 |
| 4,967,664 | 11/1990 | Iijima | 101/423 |
| 5,170,706 | 12/1992 | Rodi et al. | 101/148 |
| 5,365,849 | 11/1994 | Spiegel | 101/423 |

FOREIGN PATENT DOCUMENTS

| | | |
|---|---|---|
| 2316635 | 10/1973 | Germany . |
| 3606006 | 10/1986 | Germany . |
| 3640295 | 10/1987 | Germany . |
| 9212582 | 1/1993 | Germany . |
| 0923375 | 4/1963 | United Kingdom . |
| 1434025 | 4/1976 | United Kingdom . |
| 2270650 | 3/1994 | United Kingdom . |

*Primary Examiner*—Edgar S. Burr
*Assistant Examiner*—Lynn D. Hendrickson
*Attorney, Agent, or Firm*—Nils H. Ljungman & Associates

[57] ABSTRACT

A rotary printing press has a washing mechanism for washing ink residue off of the roller arrangement therein. The washing mechanism has a washing medium applicator and an arrangement of rollers which comprises a roller that can be positioned to split the flow of washing medium into two paths to direct the flow in essentially the shortest route possible to the distribution rollers located at the plate cylinder. The washing mechanism can also have a doctor-blade device for scraping the soiled washing medium from the rollers, and the doctor-blade device can be activated by the same mechanism which activates the positioning of the roller which splits the flow of washing medium.

20 Claims, 4 Drawing Sheets

WASHING DEVICE SELECTIVELY ENGAGEABLE WITH PLURAL INKING PATHS

BACKGROUND OF THE INVENTION

1. Field of the Invention

This invention generally relates to a printing press, such as a rotary printing press, and more particularly to a rotary printing press having a washing device for washing the rollers therein. Such a washing device can typically comprise an application device for applying a washing medium to the rollers within the press, and a doctor-blade device for removing the soiled washing medium from the rollers.

2. Background Information

The German Patent publication 36 06 006 Al discloses a washing device for a printing press, in which washing medium is applied to the inking rollers at two separate points. One goal, among others, of such an arrangement having multiple application cites for application of washing medium is to reduce the washing cycle. This known embodiment however requires enormous structural efforts as well as control efforts, and requires that a relatively large quantity of soiled washing medium must be removed due to the multiple application of the washing medium.

OBJECT OF THE INVENTION

Proceeding from such a known arrangement as described above, it is the object of the present invention to optimize the distribution of washing medium through the use of preferably only one washing-medium application, while still being able to reduce the washing cycle.

SUMMARY OF THE INVENTION

According to the present invention, this object can be achieved in an inking unit which is provided with an engageable roller, which engageable roller, during the supply of washing medium, can be engaged from a roller adjacent the washing medium supply to a subsequent roller, thereby providing an alternative washing medium supply path and reducing the distances over which the washing medium is distributed. The present invention also provides that the doctor-blade device can then be engaged at an even further subsequent roller of the inking unit.

In other words, near the point of entry of washing medium into the inking unit, the engageable roller can preferably be engaged to essentially split the washing medium being applied, into two roller trains. One of the two roller trains of the inking unit can preferably be the roller train unit provided for the initial inking of the plate cylinder, seen in the direction of rotation of the plate cylinder, and the other one of the roller trains of the inking unit can preferably be the roller train supplying the subsequent inking rollers of the plate cylinder with washing medium. This makes it possible to easily supply essentially the entire inking unit with washing medium relatively quickly so that the dissolving of the adherent ink particles can be optimized and the washing cycle of the inking unit can be reduced without producing large amounts of washing medium waste. After completion of the washing process, the engageable roller can then be disengaged from the subsequent inking-unit roller so that the setup of the inking unit would then generally not be subjected to any changes during the following print run. The engageable roller can also preferably serve as a rider roller to provide a further splitting and more uniform distribution of the ink film.

An advantageous embodiment of the present invention is characterized in that the doctor-blade device is actuated by means of an adjusting device, which adjusting device can preferably be connected to trip cams via an adjusting member, wherein the trip cams can actuate the engageable roller. Thus, this advantageous embodiment provides a single adjusting device for operating both the doctor blades and the engageable roller. The use of only one adjusting device keeps the technical efforts low. The technical efforts can be even further reduced by configuring the adjusting device to be adjustable manually.

A further advantageous embodiment of the present invention is characterized in that, the adjusting means can be configured to have three positions. A first position can be provided for essentially normal printing operation in which both the engageable roller is disengaged from the subsequent roller and the doctor-blade device is also disengaged from the rollers. A second position can be provided wherein the adjusting means engages the engageable roller with the subsequent roller of the inking unit during the washing process, with the doctor-blade device still disengaged. And a third further position can be provided in which the doctor-blade device can also be engaged at a distributor roller. By providing the multi-position adjustment, first of all, in the first position, the printing press can be operated normally, in the second position, all inking-unit rollers can then be supplied with the washing medium to dissolve any ink residues, and then, in the third position, soiled washing medium can be wiped off, after the washing medium has been given some time to dissolve any ink residues.

In summary, one aspect of the invention resides broadly in a printing press comprising: a frame; a plate cylinder rotatably mounted on the frame, the plate cylinder for positioning a printing plate thereon; an ink reservoir for holding a supply of ink; an inking mechanism for transferring the ink between the ink reservoir and the plate cylinder; the inking mechanism comprising a plurality of inking rollers, a plurality of individually adjustable ink zone metering devices disposed in conjunction with the ink reservoir, at least one ink fountain roller positioned adjacent the plurality of individually adjustable ink zone metering devices to receive ink via the metering devices, and at least one ink transfer roller for transferring ink between the ink fountain roller and at least one of the plurality of inking rollers; at least a first ink applicator roller for being engaged with the printing plate at a first location for applying ink to the printing plate at the first location; at least a second ink applicator roller for being engaged with the printing plate at a second location for applying ink to the printing plate at the second location; the plurality of inking rollers comprising a first set of at least one inking roller and a second set of at least one inking roller, the first set for providing ink to the at least a first ink transfer roller and the second set for providing ink to the at least a second ink transfer roller; at least one roller of the first set of inking rollers being disposed in contact with at least one roller of the second set of inking rollers to transfer ink from the first set of inking rollers to the second set of inking rollers; the plurality of inking rollers further comprises a third set of inking rollers for transferring ink from the ink transfer roller to at least one roller of the first set of inking rollers, the first and third sets of inking rollers defining a first fluid path therebetween to directly transfer fluid from the third set of inking rollers to the first set of inking rollers; apparatus for washing the plurality of inking rollers and the ink transfer rollers, the washing apparatus comprising: apparatus for supplying washing fluid onto at least one roller of the third set of inking rollers, the washing fluid for being transferred among the plurality of inking rollers and the ink transfer rollers to wash the plurality of inking rollers and the ink transfer rollers; at least one bridging roller, the at least one bridging roller being movable into and out of contact between at least one roller of the second set of inking rollers and at least one roller of the third set of inking rollers to define a second fluid path between the second and third sets of inking rollers to directly transfer washing fluid from the third set of inking rollers to the second set of inking rollers; the washing fluid further being transferred along the first fluid path directly from the third set of inking rollers to the first set of inking rollers; apparatus for engaging and disengaging, the apparatus for engaging and disengaging comprising apparatus for engaging the bridging roller between the at least one roller of the third set of inking rollers and the at least one roller of the second set of inking rollers to directly transfer washing fluid from the third set of inking rollers to the second set of inking rollers, and the apparatus for engaging and disengaging further comprising apparatus for disengaging the bridging roller between the third set of inking rollers and the second set of inking rollers; and removing apparatus for removing washing fluid, having been transferred among the rollers, from at least one of the plurality of inking rollers.

A further aspect of the invention resides broadly in a washing device for washing an inking unit of a printing press, the inking unit comprising: a first ink applicator roller for being engaged with a printing plate at a first location for applying ink to the printing plate at the first location; a second ink applicator roller for being engaged with the printing plate at a second location for applying ink to the printing plate at the second location; a plurality of inking rollers for receiving ink and transferring the ink to the first and second ink applicator rollers, the plurality of inking rollers comprising a first set of at least one inking roller and a second set of at least one inking roller, the first set for providing ink to the at least a first ink transfer roller and the second set for providing ink to the at least a second ink transfer roller; at least one roller of the first set of inking rollers being disposed in contact with at least one roller of the second set of inking rollers to transfer ink from the first set of inking rollers to the second set of inking rollers; and the plurality of inking rollers further comprises a third set of inking rollers for receiving ink and transferring ink to at least one roller of the first set of inking rollers, and the first and third sets of inking rollers defining a first fluid path therebetween to directly transfer fluid from the third set of inking rollers to the first set of inking rollers. The washing device comprises: apparatus for supplying washing fluid onto at least one roller of the third set of inking rollers, the washing fluid for being transferred among the plurality of inking rollers and the ink transfer rollers to wash the plurality of inking rollers and the ink transfer rollers; at least one bridging roller, the at least one bridging roller being movable into and out of contact between at least one roller of the second set of inking rollers and at least one roller of the third set of inking rollers to define a second fluid path between the second and third sets of inking rollers to directly transfer washing fluid from the third set of inking rollers to the second set of inking rollers; the washing fluid further being transferred along the first fluid path directly from the third set of inking rollers to the first set of inking rollers; apparatus for engaging and disengaging, the apparatus for engaging and disengaging comprising apparatus for engaging the bridging roller between the at least one roller of the third set of inking rollers and the at least one roller of the second set of inking rollers to directly transfer washing fluid from the third set of inking rollers to the second set of inking rollers, and the apparatus for engaging and disengaging further comprising apparatus for disengaging the bridging roller between the third set of inking rollers and the second set of inking rollers; and apparatus for removing washing fluid, having been transferred among the rollers, from at least one of the plurality of inking rollers.

Another aspect of the invention resides broadly in a method for washing an inking unit of a printing press, the inking unit comprising a plurality of inking rollers for receiving ink and transferring the ink to a plate cylinder of a printing press, the plurality of inking rollers comprising a first set of inking rollers and a second set of inking rollers, the first set for providing ink to a first location on a plate cylinder and the second set for providing ink to a second location on a plate cylinder, and a third set of inking rollers for receiving ink and transferring ink to at least one roller of the first set of inking rollers, at least one roller of the first set of inking rollers being disposed in contact with at least one roller of the second set of inking rollers to transfer ink from the first set of inking rollers to the second set of inking rollers; and the first and third sets of inking rollers defining a first fluid path therebetween to directly transfer fluid from the third set of inking rollers to the first set of inking rollers. The method comprises the steps of: supplying washing fluid onto at least one roller of the third set of inking rollers with apparatus for supplying washing fluid; transferring washing fluid among the plurality of inking rollers and the ink transfer rollers to wash the plurality of inking rollers and the ink transfer rollers; providing at least one bridging roller between at least one roller of the second set of inking rollers and at least one roller of the third set of inking rollers to define a second fluid path between the second and third sets of inking rollers, the second fluid path being different from the first fluid path; directly transferring washing fluid from the third set of inking rollers to the second set of inking rollers along the second fluid path; directly transferring washing fluid from the third set of inking rollers to the first set of inking rollers along the first fluid path; and removing washing fluid, having been transferred among the rollers, from at least one of the plurality of inking rollers, with apparatus for removing washing fluid.

BRIEF DESCRIPTION OF THE DRAWINGS

The embodiments of the present invention are further described below with reference to the schematic illustrations in the accompanying drawings, in which.

DESCRIPTION OF THE PREFERRED EMBODIMENTS

Figure 1:
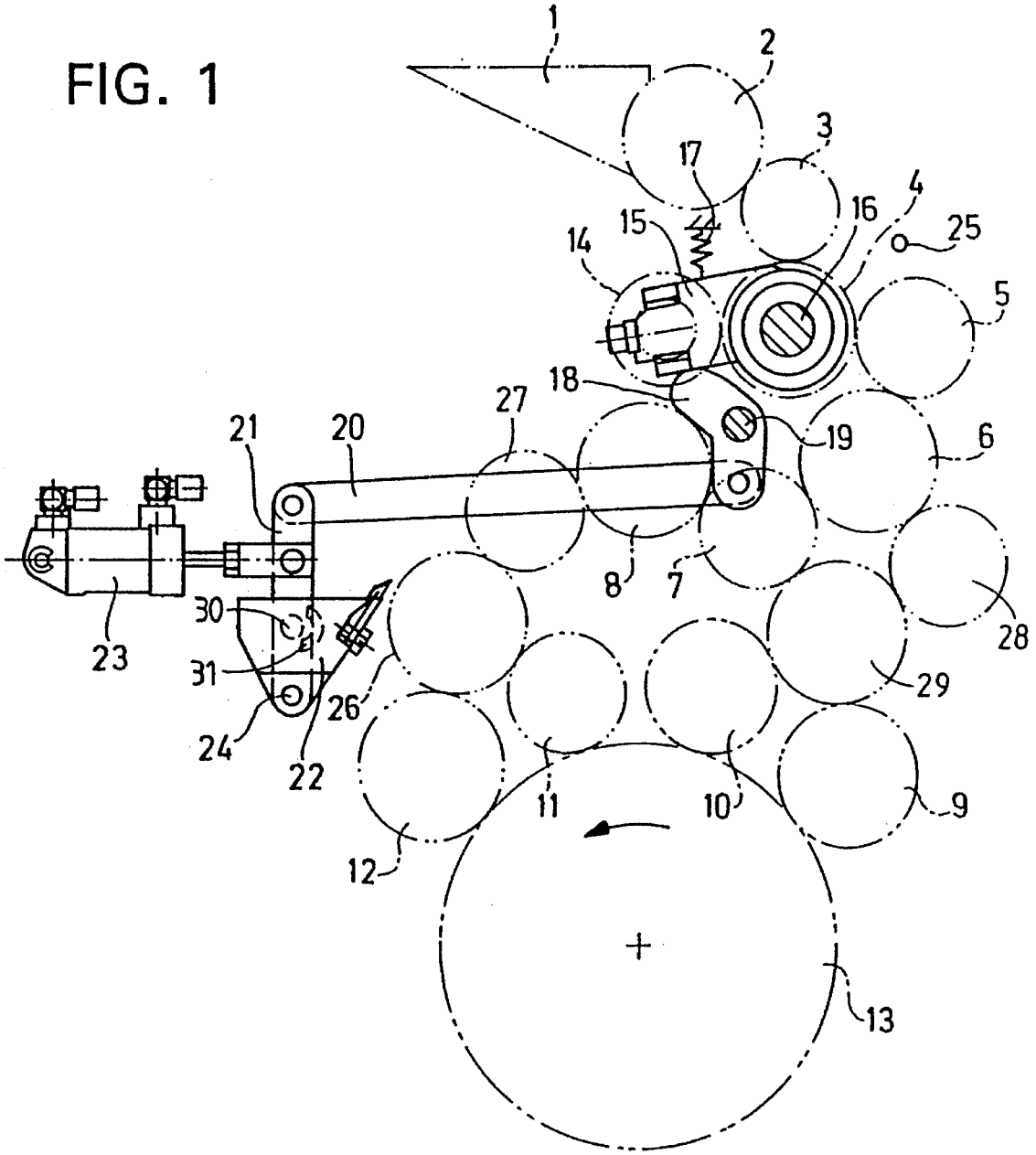
FIG. 1 shows, in greater detail, an inking unit, with the washing device in a disengaged position.
Figure 1A:
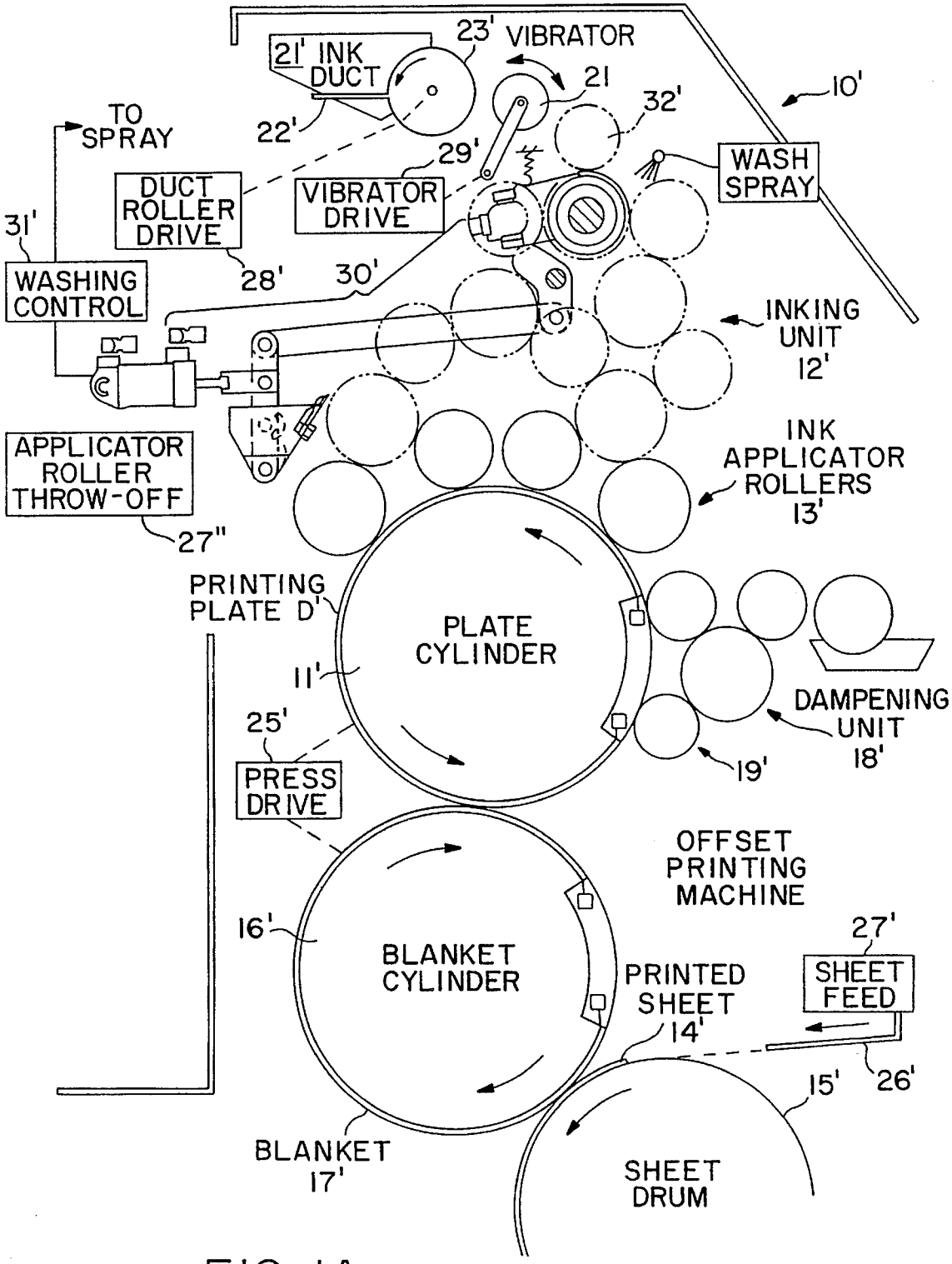
FIG. 1A shows a print stand of a printing press having a washing device in accordance with the present invention.

FIG. 1A illustrates a rotary print stand 10' of a rotary printing press which can employ a washing device 30' in accordance with at least one embodiment of the present invention, and described in further detail herein below. Rotary print stand 10' can generally include: a plate cylinder 11' for having mounted thereon a printing plate D'; an inking unit 12' which includes ink applicator rollers 13' for applying ink to the printing plate; a dampening (or wetting) unit 18' having dampening applicator rollers 19' for transferring a dampening agent to the printing plate, a blanket cylinder 16' carrying a rubber blanket 17' for receiving an ink impression from the printing plate, and a sheet drum 15' for carrying a printed sheet 14' onto which the ink impression carried by blanket 17' is transferred. A duct roller 23' can typically be mounted adjacent to ink duct 21'. Typically, ink is transferred from duct roller 23' to inking unit 12' by means of a vibrator roller 21 which oscillates to successively pick up ink from duct roller 23' and deposit the same on a roller 32' of inking unit 12'. Typically, the printing stand 10' will also include auxiliary mechanisms such as, for example, a duct roller drive 28', a vibrator roller drive 29', an applicator roller throw-off 27" for lifting the ink applicator rollers 13' off of the printing plate, a press drive 25' and a sheet feed 27' for supplying the sheets to be printed 26' to sheet drum 15'.

Figure 2:
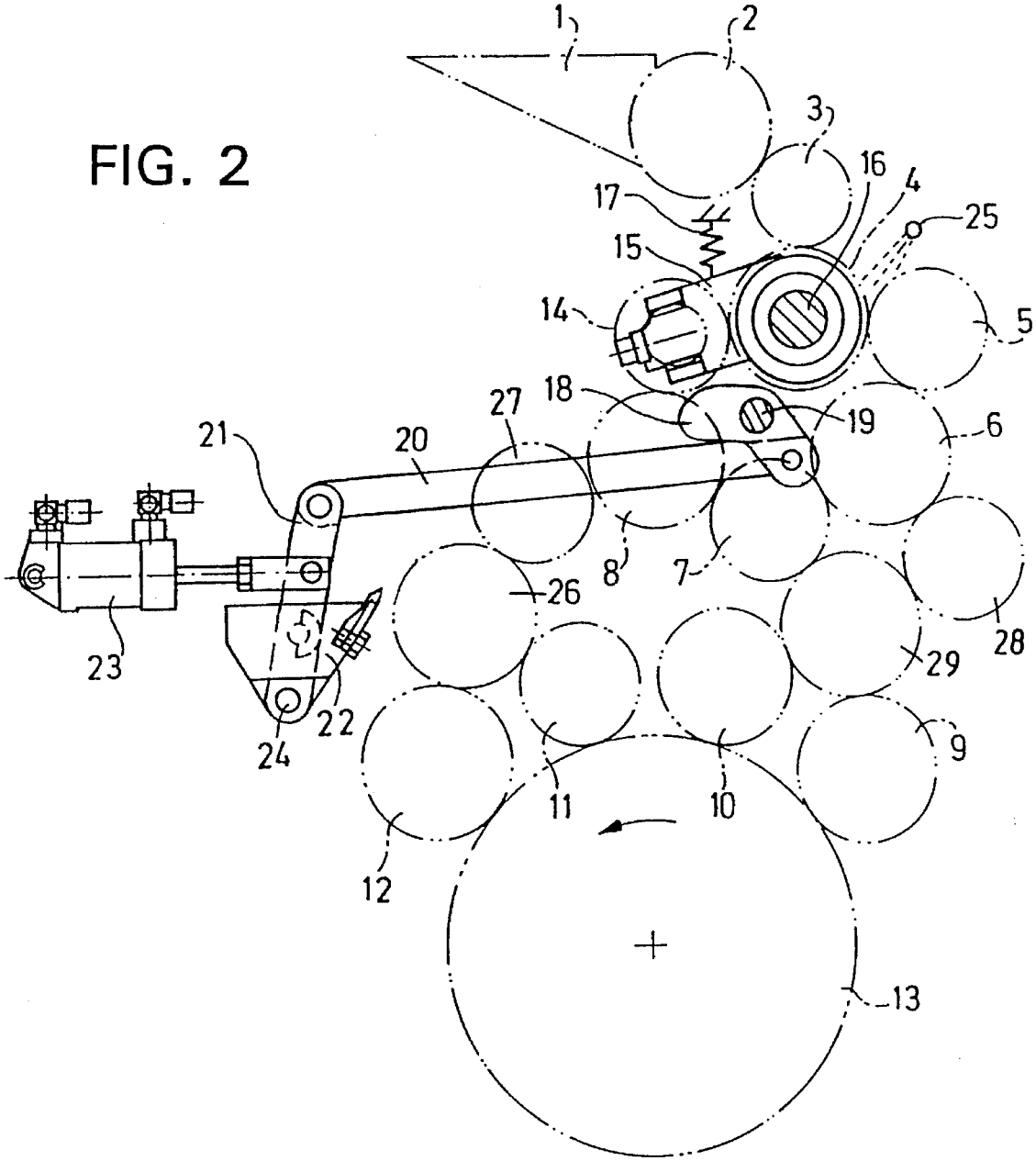
FIG. 2 shows a view similar to that of FIG. 1, but with the engageable roller engaged and the doctor-blade device still disengaged.
Figure 3:
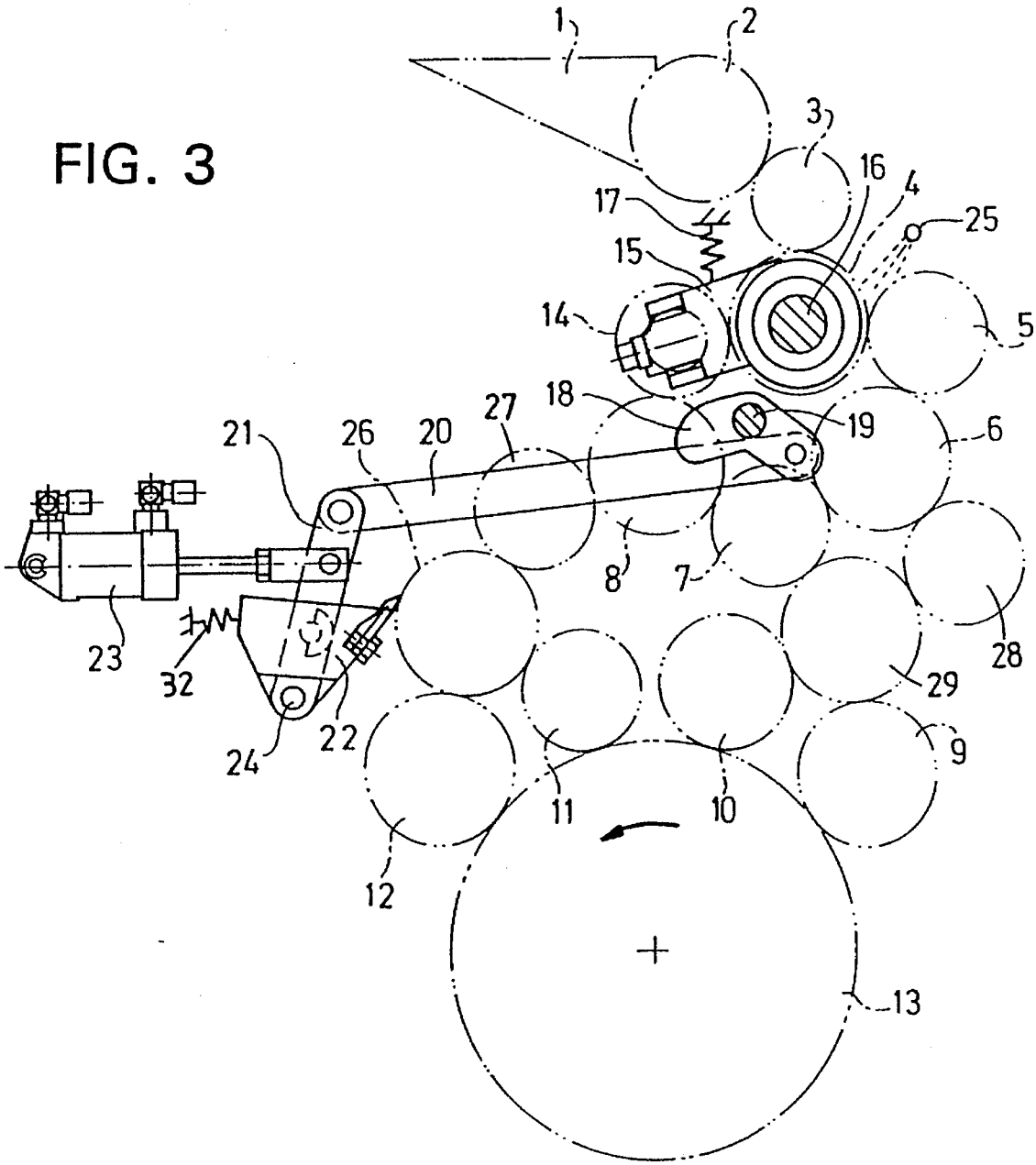
FIG. 3 shows a further view similar to that of FIGS. 1 and 2, but with the washing device fully engaged.

It should be understood that the components discussed above with relation to FIG. 1A may, if appropriate, essentially be considered to be interchangeable with similar components discussed herebelow with relation to FIGS. 1–3.

An inking unit as shown in greater detail in FIG. 1, can comprise an ink fountain 1, a fountain roller 2, a vibrator roller 3, and inking-unit rollers 4 through 8 supplying the forme rollers 9–12 with ink via further rollers 26–29. The forme rollers 9–12, in turn, can ink the printing plate (not shown) of the plate cylinder 13.

In the specimen embodiment shown in FIGS. 1–3, a roller 14 can be engageable at the inking-unit roller 8, and can be assigned to, or be in engagement with, the inking-unit roller 4. This inking unit roller 4 can essentially be a rider roller. Via swivelling levers 15, the roller 14 can be mounted so as to be swivellable about the journals 16 of the inking-unit roller 4. The roller 14 can preferably be adjustable with respect to the inking-unit roller 4 so that there can essentially always be a rolling contact between the two rollers 14 and 4. The roller 14 can thereby act as a rider roller essentially during any printing processes. Under the force of compression springs 17, the swivelling levers 15 can be forced to abut against trip cams 18. In turn, trip cams 18 can be pivot-mounted on the machine side frames via a shaft 19. An adjusting member 20 can then be provided to connect the trip cam 18 to a bearing lever 21, and the doctor-blade device 22 can be attached to the bearing lever 21. The doctor-blade device 22 can also be mounted in the side frames of the printing press via swivel bolts 24.

In general, FIG. 1 essentially depicts the positioning of the roller 14, the doctor-blade device 22, and associated components, as discussed above, in what might be considered to be a "printing configuration" of the press, for printing on sheets of printing stock, wherein the washing apparatus is disengaged.

For operation of the press, and the washing apparatus, in particular, a control device 31', as shown in FIG. 1A, can be provided. This component 31' can preferably be a portion of a main control unit (not shown) for operation of essentially the entire press, or could be a separate unit for carrying out only the washing cycle.

In the specimen embodiment shown in FIG. 1, an adjusting means 23 is preferably provided to act on the bearing lever 21. As shown in the depicted embodiment, the adjusting means can be designed as a pneumatic cylinder, and can be operated by the control apparatus 31' as shown in FIG. 1A. Instead of using a pneumatic cylinder, however, it can also be possible to effect a manual actuation e.g. by means of an adjusting lever. Alternatively, other types of adjusting devices could also be used, such as an electric motor, a worm gear, etc., and substitution of such for the described pneumatic cylinder would be well within the skill of the artisan.

After a printing run, or several printing runs, are conducted, or after the press has been idle for a period of time, an ink residue could possibly form on the various rollers, etc., of the inking unit. Thus, a washing medium would typically then be applied to the rollers to perform a cleaning operation.

FIG. 2 shows the adjusting means during what could be considered to be an initial period of a washing cycle, or a second position of the adjusting means and washing apparatus. In this second position, washing medium is being applied onto the inking-unit rollers 4, 5 through an application device 25—e.g. a spraying pipe, applying the washing medium. Alternatively, other types of washing medium application devices could also be used, such as possibly a dipping roller.

At some point in time, which could approximately coincide with the spraying of the washmedium, that is, be slightly before, the same as, or after, the start of spraying of the washing medium, the trip cam 18 can preferably be swivelled downwards a sufficient amount so that, under the force of the compression spring 17, the swivelling lever 15 can be swivelled together with the roller 14 in a counterclockwise direction. In this manner, the roller 14 can come into contact with the inking-unit roller 8. Thus, part of the applied washing medium can be transferred, via the inking-unit rollers 5, 6 onto the forme rollers 9, 10, via essentially the shortest route, or via intermediate rollers 7, 28 and 29. The remainder of the washing medium can be supplied, via the engaged roller 14, essentially directly to the inking-unit roller 8, and, via the subsequent rollers 26 and 27, to the forme rollers 11, 12, again via essentially a shortest path. Without the engageable roller 14, the washing medium would have to be supplied to the inking-unit 8 via the rollers 5, 6, 7. Accordingly, this would result in a longer travel path, and thus a longer washing cycle.

In a third position of the adjusting device 23 and washing apparatus, as depicted in FIG. 3, the doctor-blade device 22 can be engaged e.g. at the distributor roller 26. The doctor-blade device 22 can preferably be engaged with the roller 26 a short period of time after the washing cycle has been initiated, to thereby preferably allow the washing medium to have been essentially fully circulated through the various roller trains. After a predetermined period of time, the adjusting device 23 can be actuated to push the bearing lever 21 and thereby engage a pin 30 with an additional cam 31 (see FIG. 1) and pivot the doctor-blade device into contact with the roller 26. It might also be desirable at this juncture to shut off the flow of washing medium at the application device 25 to thereby allow the soiled washing medium to be removed from the rollers. Alternatively, the washing medium could be allowed to flow for a further predetermined period of time if so desired to,achieve a desired degree of cleaning.

After at least a substantial portion of the soiled washing medium is removed, the doctor-blade device 22 and the roller 14 can be returned back into their respective disengaged position by actuating the adjusting device 23 to pull the bearing lever back to the left (as shown in the figures), thereby allowing the doctor-blade device 22 to be returned to its normal position, possibly by means of a resilient member 32, and also causing the cam 18 to be rotated about shaft 19 in a clockwise direction to push the roller 14 out of engagement with the roller 8. The doctor-blade device could also possibly be returned to its disengaged position by means of a simple counterbalancing of weight, wherein the side of the device 22 disposed away from the roller 26 might be counter-weighted, in an appropriate manner, to cause the device 22 to pivot away from the roller 26 upon movement of the lever 21 away from the roller 26, thereby alleviating the holding pressure of the pin 30 on the cam 31.

With the embodiment as discussed above, wherein an adjusting device 23 is provided for movement of the lever 21, the adjusting device 23 could preferably be configured to have essentially three positions, or in other words, the three positions as depicted in FIGS. 1, 2 and 3. Alternatively, if other types of adjusting devices are used, or if a device for manual adjustment is provided, such devices could also be configured to essentially operate, or have, three positions for positioning of the lever 21 and operation of the cams 18 and doctor-blade device 22.

By connecting the trip cams 18 to the adjusting device 23 of the doctor-blade device 22, it is easily possible to achieve an optimum distribution of the washing medium and to carry out the washing cycle as quickly as possible under optimum conditions.

In view of the above-discussed embodiments and methods, it will be appreciated that variations would be possible within the skill of the artisan. For example, it might be desirable, under some circumstances, to skip over the intermediate position and essentially simultaneously engage both the roller 14 and the doctor-blade device 22, by having a single movement of the adjusting device 23 from a left-most position, to a right-most position in the depicted views. Also, the positioning of the various rollers would also be variable depending on the printing press, and the space available. In general, one aspect of the invention could essentially be seen as the provision of only a single washing medium supply, while providing the shortest possible route of travel between the washing medium supply and the distribution rollers at the plate cylinder, which is achieved by splitting the flow of washing medium into two paths. Alternatively, the flow of medium could possibly also be split into possibly three, or more paths depending on the placement of the rollers, and the engagement location of the engageable roller 14.

One feature of the invention resides broadly in the washing device for an inking unit of a rotary printing machine comprising an application device applying the washing medium and a doctor-blade device for wiping the dissolved ink residue off the inking rollers, characterized in that in the inking unit there is provided an engageable roller 14 which is engaged at a subsequent roller 8 during the washing-medium supply 25 such that the distances over which the washing medium is distributed in the inking unit are reduced, and that the doctor-blade device is then engaged at a further inking-unit roller 26.

Another feature of the invention resides broadly in the washing device characterized in that the doctor-blade device 22 is actuated via an adjusting means 23 and connected to trip cams 18 via an adjusting member 20, said trip cams actuating the engageable roller.

Yet another feature of the invention resides broadly in the washing device characterized in that, in a first position, the engageable roller 14 is engaged at a subsequent inking-unit roller 8 during the washing process, and that, in a second position, the doctor-blade device 22 is engaged at distributor roller 26.

Examples of washing apparatus for cleaning ink from rollers, and the components thereof, which may be utilized in accordance with the present invention, may be found in the following U.S. Pat. Nos. 5,174,209, which issued to Rodi et al. on Dec. 29, 1992; 5,174,210, which issued to Rodi et al. on Dec. 29, 1992; and 3,766,853 to Gallagher et al., entitled "System for Cleaning Rollers of a Duplicating Machine, Such as Ink Rollers". A further example of washing apparatus may be found in the following patent application, Ser. No. 08/121,605 to Nikolaus Spiegel, entitled "Device for Washing an Inking Unit Provided at a Printing Press", which is commonly assigned to the same assignee as the instant application.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 22 615.9, filed on Jul. 7, 1993, having inventor Lothar Stein, and DE-OS P 43 22 615.9 and DE-PS P 43 22 615.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A printing press comprising:

a frame;

a plate cylinder rotatably mounted on said frame, said plate cylinder for positioning a printing plate thereon;

an ink reservoir for holding a supply of ink;

an inking mechanism for transferring the ink between said ink reservoir and said plate cylinder;

said inking mechanism comprising a plurality of inking rollers, a plurality of individually adjustable ink zone metering devices disposed in conjunction with the ink reservoir, at least one ink fountain roller positioned adjacent said plurality of individually adjustable ink zone metering devices to receive ink via said metering devices, and at least one ink transfer roller for transferring ink between said ink fountain roller and at least one of said plurality of inking rollers;

at least a first ink applicator roller for being engaged with said printing plate at a first location for applying ink to said printing plate at the first location;

at least a second ink applicator roller for being engaged with said printing plate at a second location for applying ink to said printing plate at the second location;

said plurality of inking rollers comprising a first set of at least one inking roller and a second set of at least one inking roller, said first set for providing ink to said at least a first ink transfer roller and said second set for providing ink to said at least a second ink transfer roller;

at least one roller of said first set of inking rollers being disposed in contact with at least one roller of said second set of inking rollers to transfer ink from said first set of inking rollers to said second set of inking rollers;

said plurality of inking rollers further comprises a third set of inking rollers for transferring ink from said ink transfer roller to at least one roller of said first set of inking rollers, said first and third sets of inking rollers defining a first fluid path therebetween to directly transfer fluid from said third set of inking rollers to said first set of inking rollers;

means for washing said plurality of inking rollers and said ink transfer rollers, said washing means comprising:

means for supplying washing fluid onto at least one roller of said third set of inking rollers, said washing fluid for being transferred among said plurality of inking rollers and said ink transfer rollers to wash said plurality of inking rollers and said ink transfer rollers;

at least one bridging roller, said at least one bridging roller being movable into and out of contact between at least one roller of said second set of inking rollers and at least one roller of said third set of inking rollers to define a second fluid path between said second and third sets of inking rollers to directly transfer washing fluid from said third set of inking rollers to said second set of inking rollers;

said washing fluid further being transferred along said first fluid path directly from said third set of inking rollers to said first set of inking rollers;

means for engaging and disengaging, said means for engaging and disengaging comprising means for engaging said bridging roller between said at least one roller of said third set of inking rollers and said at least one roller of said second set of inking rollers to directly transfer washing fluid from said third set of inking rollers to said second set of inking rollers, and said means for engaging and disengaging further comprising means for disengaging said bridging roller between said third set of inking rollers and said second set of inking rollers; and removing means for removing washing fluid, having been transferred among said rollers, from at least one of said plurality of inking rollers.

2. The printing press according to claim 1, wherein said means for engaging and disengaging further comprises means for engaging and disengaging said means for removing to engage said means for removing said at least one of said plurality of inking rollers to remove washing fluid from said one of said plurality of inking rollers and disengage said means for removing from said one of said plurality of inking rollers.

3. The printing press according to claim 2, wherein:

said means for engaging and disengaging comprises a first position wherein:

said bridging roller is disengaged from between said third set of inking rollers and said second set of inking rollers; and said means for removing is disengaged from said one of said plurality of inking roller;

said means for engaging and disengaging comprises a second position wherein:

said bridging roller is engaged between said third set of inking rollers and said second set of inking rollers; and said means for removing is disengaged from said one of said plurality of inking roller; and said means for engaging and disengaging comprises a third position wherein:

said bridging roller is engaged between said third set of inking rollers and said second set of inking rollers; and said means for removing is engaged with said one of said plurality of inking roller.

4. The printing press according to claim 3, wherein:

said at least one bridging roller is configured for being movable into and out of contact between at least one roller of said second set of inking rollers and said at least one roller of said third set of inking rollers to which washing fluid is applied to minimize said second fluid path;

said means for removing comprises a scraping device for scraping washing fluid from one of said plurality of rollers; and said one roller engaged by said means for removing comprises a roller of said second set of inking rollers.

5. The printing press according to claim 4, wherein:

said means for engaging and disengaging comprises lever means pivotably mounted in said printing press, said lever means having a first end and a second end, and said lever means being pivotably mounted in said printing press adjacent the first end of said lever means;

said lever means comprises a first portion for engaging said bridging roller and a second portion for engaging said means for removing for engagement and disengagement of said bridging roller and said means for removing upon pivoting of said lever means;

said lever means is pivotable between a first position corresponding to said first position of said means for engaging and disengaging, a second position corresponding to said second position of said means for engaging and disengaging, and a third position corresponding to said third position of said means for engaging and disengaging, said first, second and third position of said lever means being sequentially disposed;

said lever means is pivotable from said first position to said second position to engage said bridging roller between said at least one roller of said second set of inking rollers and said roller of said third set of inking rollers to which washing fluid is applied; and said lever means is pivotable from said second position to said third position to engage said scraping means with said roller of said second set of inking rollers.

6. The printing press according to claim 5, wherein:

said plate cylinder has a direction of rotation;

said at least a second ink applicator roller is disposed subsequent to said at least a first ink applicator roller in the direction of rotation of said plate cylinder;

said at least a first ink applicator roller comprises two first ink applicator rollers;

said at least a second ink applicator roller comprises two second ink applicator rollers;

said second set of inking rollers comprises a first inking roller in contact with said at least one roller of said first set of inking rollers, and a second inking roller in contact with each of said two second ink applicator rollers;

said bridging roller is configured for being engaged between said first roller of said second set of inking rollers and said roller of said third set of inking rollers to which washing fluid is applied;

said scraping means is configured for engaging and disengaging with said second inking roller of said second set of inking rollers;

said first set of inking rollers comprises a third inking roller in contact with at least one inking roller of said third set of inking rollers and also in contact with said first inking roller of said second set of inking rollers, and a fourth inking roller in contact with both of said two first ink applicator rollers and also said third inking roller.

7. The printing press according to claim 6, wherein:

said third set of inking rollers comprises a fifth inking roller for receiving ink from said ink transfer roller and for receiving washing fluid from said means for supplying washing fluid, and a sixth inking roller disposed in contact with said third inking roller of said first set of inking rollers;

said first fluid path comprises at least said fifth inking roller, said sixth inking roller, said third inking roller, said fourth inking roller and said two first ink applicator rollers;

said second fluid path comprises at least said fifth inking roller, said bridging roller, said first inking roller, said second inking roller and said two second ink applicator rollers;

said fifth inking roller comprises bracket means for mounting said bridging roller in rolling contact therewith;

said bracket means being pivotable about said fifth inking roller to pivot said bridging roller into and out of contact with said first inking roller;

said first portion of said lever means of said means for engaging and disengaging comprises means for pivoting said bracket means about said fifth inking roller to engage and disengage said bridging roller with said first inking roller;

said first portion of said means for engaging and disengaging comprises:

cam means pivotably mounted in said printing press; and a connecting rod extending from said second end of said lever means to said cam means to pivot said cam means upon pivoting of said lever means;

said cam means being configured to pivot away from said bracket means upon pivoting of said lever means from said first position to said second position to engage said bridging roller into contact with said first inking roller; and said bracket means further comprise biasing means for biasing said bridging roller towards said first inking roller to maintain said bridging roller in engagement with said first inking roller in said second and third positions of said lever means.

8. The printing press according to claim 7, wherein:

said scraping means comprises a doctor blade device;

said doctor blade device having a second cam means;

said second portion of said lever means comprises a projection for engaging said second cam means for movement of said doctor blade device upon pivoting of said lever means from said second position to said third position;

said means for engaging and disengaging further comprises a pneumatic cylinder for moving said lever means between said first, second and third positions of said lever means;

said doctor blade device further comprises:

a doctor blade for scraping said second inking roller; and trough means for catching washing fluid scraped from said second inking roller;

said second set of inking rollers comprises a seventh inking roller disposed between and in contact with each of said first and second inking rollers;

said first set of inking rollers comprises an eighth inking roller disposed between and in contact with said sixth inking roller and said fourth inking roller;

said third set of inking rollers comprises a ninth inking roller disposed between and in contact with said fifth inking roller and said sixth inking roller;

said means for applying washing medium comprises a spray device for spraying washing medium onto each of said fifth and ninth inking rollers;

said first fluid path additionally comprises said ninth and eighth inking rollers;

said second fluid path additionally comprises said seventh inking roller; and said printing press further comprises:

sheet feeding means for feeding sheets of printing stock into the printing press;

a rubber blanket cylinder having a rubber blanket disposed thereabout for receiving an ink impression from the plate cylinder;

a sheet drum for receiving sheets being fed for printing the ink impression of the rubber blanket onto the sheets;

dampening means for applying dampening medium to said printing plate; and control means for controlling operation of said pneumatic cylinder.

9. A washing device for washing an inking unit of a printing press, the inking unit comprising: a first ink applicator roller for being engaged with a printing plate at a first location for applying ink to the printing plate at the first location; a second ink applicator roller for being engaged with the printing plate at a second location for applying ink to the printing plate at the second location; a plurality of inking rollers for receiving ink and transferring the ink to said first and second ink applicator rollers, said plurality of inking rollers comprising a first set of at least one inking roller and a second set of at least one inking roller, said first set for providing ink to said at least a first ink transfer roller and said second set for providing ink to said at least a second ink transfer roller; at least one roller of said first set of inking rollers being disposed in contact with at least one roller of said second set of inking rollers to transfer ink from said first set of inking rollers to said second set of inking rollers; and said plurality of inking rollers further comprises a third set of inking rollers for receiving ink and transferring ink to at least one roller of said first set of inking rollers, said first and third sets of inking rollers defining a first fluid path therebetween to directly transfer fluid from said third set of inking rollers to said first set of inking rollers; and said washing device comprises:

means for supplying washing fluid onto at least one roller of said third set of inking rollers, said washing fluid for being transferred among said plurality of inking rollers and said ink transfer rollers to wash said plurality of inking rollers and said ink transfer rollers;

at least one bridging roller, said at least one bridging roller being movable into and out of contact between at least one roller of said second set of inking rollers and at least one roller of said third set of inking rollers to define a second fluid path between said second and third sets of inking rollers to directly transfer washing fluid from said third set of inking rollers to said second set of inking rollers;

said washing fluid further being transferred along said first fluid path directly from said third set of inking rollers to said first set of inking rollers;

means for engaging and disengaging, said means for engaging and disengaging comprising means for engaging said bridging roller between said at least one roller of said third set of inking rollers and said at least one roller of said second set of inking rollers to directly transfer washing fluid from said third set of inking rollers to said second set of inking rollers, and said means for engaging and disengaging further comprising means for disengaging said bridging roller between said third set of inking rollers and said second set of inking rollers; and means for removing washing fluid, having been transferred among said rollers, from at least one of said plurality of inking rollers.

10. The washing device according to claim 9, wherein said means for engaging and disengaging further comprises means for engaging and disengaging said means for removing to engage said means for removing with said at least one of said plurality of inking rollers to remove washing fluid from said one of said plurality of inking rollers and disengage said means for removing from said at least one of said plurality of inking rollers.

11. The washing device according to claim 10, wherein:

said means for engaging and disengaging comprises a first position wherein:

said bridging roller is disengaged from between said third set of inking rollers and said second set of inking rollers; and said means for removing is disengaged from said at least one of said plurality of inking roller;

said means for engaging and disengaging comprises a second position wherein:

said bridging roller is engaged between said third set of inking rollers and said second set of inking rollers; and said means for removing is disengaged from said at least one of said plurality of inking roller; and said means for engaging and disengaging comprises a third position wherein:

said bridging roller is engaged between said third set of inking rollers and said second set of inking rollers; and said means for removing is engaged with said at least one of said plurality of inking roller.

12. The washing device according to claim 11, wherein:

said at least one bridging roller is configured for being movable into and out of contact between at least one roller of said second set of inking rollers and said at least one roller of said third set of inking rollers to which washing fluid is applied to minimize said second fluid path;

said means for removing comprises a scraping device for scraping washing fluid from one roller engaged by said means for removing; and said one roller engaged by said means for removing comprises a roller of said second set of inking rollers.

13. The washing device according to claim 12, wherein:

said means for engaging and disengaging comprises lever means for being pivotably mounted in a printing press, said lever means having a first end and a second end, and said lever means for being pivotably mounted in said printing press adjacent the first end of said lever means;

said lever means comprises a first portion for engaging said bridging roller and a second portion for engaging said means for removing for engagement and disengagement of said bridging roller and said means for removing upon pivoting of said lever means;

said lever means is pivotable between a first position corresponding to said first position of said means for engaging and disengaging, a second position corresponding to said second position of said means for engaging and disengaging, and a third position corresponding to said third position of said means for engaging and disengaging, said first, second and third position of said lever means being sequentially disposed;

said lever means is pivotable from said first position to said second position to engage said bridging roller between said at least one roller of said second set of inking rollers and said roller of said third set of inking rollers to which washing fluid is applied; and said lever means is pivotable from said second position to said third position to engage said scraping means with said roller of said second set of inking rollers.

14. The washing device according to claim 13, wherein a plate cylinder in a printing press has a direction of rotation, and further wherein:

said at least a second ink applicator roller is for being disposed subsequent to said at least a first ink applicator roller in the direction of rotation of the plate cylinder;

said at least a first ink applicator roller comprises two first ink applicator rollers;

said at least a second ink applicator roller comprises two second ink applicator rollers;

said second set of inking rollers comprises a first inking roller in contact with said at least one roller of said first set of inking rollers, and a second inking roller in contact with each of said two second ink applicator rollers;

said bridging roller is configured for being engaged between said first roller of said second set of inking rollers and said roller of said third set of inking rollers to which washing fluid is applied;

said scraping means is configured for engaging and disengaging with said second inking roller of said second set of inking rollers;

said first set of inking rollers comprises:

a third inking roller in contact with at least one inking roller of said third set of inking rollers and also in contact with said first inking roller of said second set of inking rollers, and a fourth inking roller in contact with both of said two first ink applicator rollers and also said third inking roller.

15. The washing device according to claim 14, wherein:

said third set of inking rollers comprises a fifth inking roller for receiving washing fluid from said means for supplying washing fluid, and a sixth inking roller disposed in contact with said third inking roller of said first set of inking rollers;

said second set of inking rollers comprises a seventh inking roller disposed between and in contact with each of said first and second inking rollers;

said first set of inking rollers comprises an eighth inking roller disposed between and in contact with said sixth inking roller and said fourth inking roller;

said third set of inking rollers comprises a ninth inking roller disposed between and in contact with said fifth inking roller and said sixth inking roller;

said first fluid path comprises said fifth inking roller, said sixth inking roller, said third inking roller, said fourth inking roller, said ninth inking roller, said eighth inking roller, and said two first ink applicator rollers;

said second fluid path comprises at least said fifth inking roller, said bridging roller, said first inking roller, said second inking roller, said seventh inking roller and said two second ink applicator rollers;

said fifth inking roller comprises bracket means for mounting said bridging roller in rolling contact therewith;

said bracket means being pivotable about said fifth inking roller to pivot said bridging roller into and out of contact with said first inking roller;

said first portion of said lever means of said means for engaging and disengaging comprises means for pivoting said bracket means about said fifth inking roller to engage and disengage said bridging roller with said first inking roller;

said first portion of said lever means comprises:

cam means for being pivotably mounted in said printing press; and a connecting rod extending from said second end of said lever means to said cam means to pivot said cam means upon pivoting of said lever means;

said cam means being configured to pivot away from said bracket means upon pivoting of said lever means from said first position to said second position to engage said bridging roller into contact with said first inking roller;

said bracket means further comprise biasing means for biasing said bridging roller towards said first inking roller to maintain said bridging roller in engagement with said first inking roller in said second and third positions of said lever means;

said scraping means comprises a doctor blade device;

said doctor blade device having a second cam means;

said second portion of said lever means comprises a projection for engaging said second cam means for movement of said doctor blade device upon pivoting of said lever means from said second position to said third position;

said means for engaging and disengaging further comprises a pneumatic cylinder for moving said lever means between said first, second and third positions of said lever means;

said doctor blade device further comprises:

a doctor blade for scraping said second inking roller; and trough means for catching washing fluid scraped from said second inking roller; and said means for applying washing medium comprises a spray device for spraying washing medium onto each of said fifth and ninth inking rollers.

16. A method for washing an inking unit of a printing press, the inking unit comprising a plurality of inking rollers for receiving ink and transferring the ink to a plate cylinder of a printing press, said plurality of inking rollers comprising a first set of inking rollers and a second set of inking rollers, said first set for providing ink to a first location on a plate cylinder and said second set for providing ink to a second location on a plate cylinder, and a third set of inking rollers for receiving ink and transferring ink to at least one roller of said first set of inking rollers, at least one roller of said first set of inking rollers being disposed in contact with at least one roller of said second set of inking rollers to transfer ink from said first set of inking rollers to said second set of inking rollers; said first and third sets of inking rollers defining a first fluid path therebetween to directly transfer fluid from said third set of inking rollers to said first set of inking rollers; and said method comprises the steps of:

supplying washing fluid onto at least one roller of said third set of inking rollers with means for supplying washing fluid;

transferring washing fluid among said plurality of inking rollers and said ink transfer rollers to wash said plurality of inking rollers and said ink transfer rollers;

providing at least one bridging roller between at least one roller of said second set of inking rollers and at least one roller of said third set of inking rollers to define a second fluid path between said second and third sets of inking rollers, said second fluid path being different from said first fluid path;

directly transferring washing fluid from said third set of inking rollers to said second set of inking rollers along said second fluid path;

directly transferring washing fluid from from said third set of inking rollers to said first set of inking rollers along said first fluid path; and removing washing fluid, having been transferred among said rollers, from at least one of said plurality of inking rollers, with means for removing washing fluid.

17. The method according to claim 16, wherein said inking unit comprises means for engaging and disengaging said bridging roller from said roller of said second set of inking rollers, said means for engaging and disengaging said bridging roller comprises means for engaging and disengaging said means for removing to engage said means for removing to remove washing fluid from said at least one of said plurality of inking rollers and disengage said means for removing from said at least one of said plurality of inking rollers, and said method further comprises the steps of:

engaging and disengaging both said bridging roller and said means for removing with a single means for engaging and disengaging both said bridging roller and said means for removing.

18. The method according to claim 17, further comprising the steps of:

moving said means for engaging and disengaging to a first position to disengage said bridging roller from between said third set of inking rollers and said second set of inking rollers, and disengage said means for removing from said one of said plurality of inking roller;

moving said means for engaging and disengaging to a second position to engage said bridging roller between said third set of inking rollers and said second set of inking rollers, and disengage said means for removing from said one of said plurality of inking roller; and moving said means for engaging and disengaging to a third position to engage said bridging roller between said third set of inking rollers and said second set of inking rollers, and engage said means for removing with said one of said plurality of inking roller.

19. The method according to claim 18, further comprising the steps of:

moving said at least one bridging roller into and out of contact between at least one roller of said second set of inking rollers and said at least one roller of said third set of inking rollers to which washing fluid is applied to minimize said second fluid path;

configuring said means for removing as a scraping device for scraping washing fluid from said roller engaged by said means for removing, wherein said roller engaged by said means for removing comprises a roller of said second set of inking rollers.

20. The method according to claim 19, further comprising the steps of:

configuring said means for engaging and disengaging as lever means for being pivotably mounted in a printing press, said lever means having a first end and a second end, and said lever means for being pivotably mounted in said printing press adjacent the first end of said lever means;

configuring said lever means with a first portion for engaging said bridging roller and a second portion for engaging said means for removing for engagement and disengagement of said bridging roller and said means for removing upon pivoting of said lever means;

pivoting said lever means between a first position corresponding to said first position of said means for engaging and disengaging, a second position corresponding to said second position of said means for engaging and disengaging, and a third position corresponding to said third position of said means for engaging and disengaging, said first, second and third position of said lever means being sequentially disposed;

pivoting said lever means from said first position to said second position to engage said bridging roller between said at least one roller of said second set of inking rollers and said roller of said third set of inking rollers to which washing fluid is applied;

pivoting said lever means from said second position to said third position to engage said scraping means with said roller of said second set of inking rollers;

pivoting said lever means from said third position to said second position to disengage said scraping means with said roller of said second set of inking rollers; and pivoting said lever means from said second position to said first position to disengage said bridging roller between said at least one roller of said second set of inking rollers and said roller of said third set of inking rollers to which washing fluid is applied.

* * * * *